US010238210B1

(12) United States Patent
Shoenfeld

(10) Patent No.: US 10,238,210 B1
(45) Date of Patent: Mar. 26, 2019

(54) PASS-THROUGH CONVENIENCE CABINET FOR HOTEL OR SIMILAR PUBLIC ACCOMMODATION

(71) Applicant: Norman A Shoenfeld, Cypress, TX (US)

(72) Inventor: Norman A Shoenfeld, Cypress, TX (US)

(73) Assignee: S&S X-ray Products, Inc., Houston, TX (US)

( * ) Notice: Subject to any disclaimer, the term of this patent is extended or adjusted under 35 U.S.C. 154(b) by 0 days.

(21) Appl. No.: 15/706,826

(22) Filed: Sep. 18, 2017

(51) Int. Cl.

| | |
|---|---|
| ***A47B 67/02*** | (2006.01) |
| ***A47B 96/00*** | (2006.01) |
| ***G07C 9/00*** | (2006.01) |
| *E05G 1/10* | (2006.01) |

(52) U.S. Cl.
CPC ..... *A47B 67/02* (2013.01); *A47B 96/00* (2013.01); *G07C 9/00904* (2013.01); *G07C 9/00912* (2013.01); *A47B 2067/025* (2013.01); *E05G 1/10* (2013.01)

(58) Field of Classification Search
CPC ... A47B 67/02; A47B 96/00; A47B 2067/025; G07C 9/00904; G07C 9/00912; E05G 1/10; E05G 1/06; E05G 1/026; E05G 1/04; A47G 29/141; A47G 29/20; A47G 29/1201
USPC ..... 232/43.4, 43.5, 19, 1 E, 44, 24, 25; 312/286, 405, 209; 109/67, 68; 49/68; 220/476
See application file for complete search history.

(56) References Cited

U.S. PATENT DOCUMENTS

| | | | | |
|---|---|---|---|---|
| 1,391,133 | A | | 9/1921 | Matchette |
| 1,516,150 | A | | 11/1924 | Craw |
| 1,546,762 | A | | 7/1925 | Trost et al. |
| 1,674,534 | A | | 6/1928 | Trost |
| 1,686,831 | A | | 10/1928 | Matchette |
| 1,703,944 | A | | 3/1929 | Matchette |
| 3,130,395 | A | * | 4/1964 | Simjian ..... E04H 3/04 109/63.5 |
| 3,283,443 | A | | 11/1966 | Kendrick et al. |
| 5,744,053 | A | | 6/1998 | Porter |
| 5,774,053 | A | * | 6/1998 | Porter ..... A47G 29/141 232/19 |
| 5,894,277 | A | | 4/1999 | Keskin et al. |
| 5,921,191 | A | * | 7/1999 | Gabel ..... E05G 7/005 109/13 |
| 5,979,750 | A | | 11/1999 | Kindell |

(Continued)

*Primary Examiner* — William L Miller
(74) *Attorney, Agent, or Firm* — Bernhard P. Molldrem, Jr.

(57) ABSTRACT

Pass-through convenience cabinet with controlled access for a public accommodation has a hallway-side door for delivery and pickup of food service items, linen exchange, or other items, without need for staff to disturb the occupant or to enter the room. The cabinet has one or more compartments with respective room-side door or doors that can be opened by the occupant or guest. A touch screen device on the room side of the cabinet frame allows the occupant or guest to open the respective compartments, and to communicate with hotel staff to order food items or request exchange of a towel or other item. An electronic record is kept of all requests, pickups, and deliveries which may be used for management purposes. A separate compartment accessible only from within the room may be used as a room safe. The cabinet can be configured to service a pair of adjacent guest rooms.

20 Claims, 8 Drawing Sheets

(56) References Cited

U.S. PATENT DOCUMENTS

| | | | | |
|---|---|---|---|---|
| 6,079,216 | A * | 6/2000 | de Marsillac Plunkett | A47G 29/20 109/7 |
| 6,415,552 | B1 | 7/2002 | Khosropour | |
| 6,484,531 | B1 * | 11/2002 | Hambleton | A47G 29/141 312/286 |
| 6,598,546 | B2 * | 7/2003 | Alexander | E06B 7/28 109/67 |
| 6,967,575 | B1 | 11/2005 | Dohrmann et al. | |
| 8,160,741 | B1 | 4/2012 | Shoenfeld | |
| 8,473,097 | B2 | 7/2013 | Shoenfeld | |

* cited by examiner

PASS-THROUGH CONVENIENCE CABINET FOR HOTEL OR SIMILAR PUBLIC ACCOMMODATION

BACKGROUND OF THE INVENTION

This invention relates to cabinets or storage facilities for use in hotel rooms for delivery or storage of items that may be requested by a guest or other occupant of a room or suite in a hotel or similar facility. The invention is more particularly concerned with a convenient and efficient mechanism for receiving requested items, such as food service deliveries to the room or suite, or requests for linen items such as towels, sheets, soap, shampoo, to the room, and for holding items to be returned to or picked up by hotel staff.

At present it is typical for a hotel or similar guest accommodation, even for an expensive upscale hotel or resort, that the hallway is littered with trays containing dirty dishes. That is, the guest or customer has no place to store or return the dishes, trays, and flatware from a room-service delivery, except to place them in the hallway outside the guest room door. This creates an eyesore and diminishes the appearance of the hotel, as well as creating a potential tripping hazard and a liability risk.

If a guest wants to order breakfast from room service, the guest phones down to the desk and places an order. The timing is such that the meal arrives in a 15-30 minute window, which can create awkward situations for the guests: The guest may be in the shower when the meal arrives; or the guest or spouse may not be fully dressed, and would not want a stranger entering the room, when the guest is not ready.

Also, if the room occupant determines that he or she needs an extra towel or extra blanket, the guest can call housekeeping, and someone from housekeeping staff will bring the item to the room sometime thereafter, and the same situation may appear that the person is not dressed, is in the bath or shower, or is absent from the room when the staff member comes and knocks on the door.

These issues can be resolved by employing a cabinet for each room that allows the hotel staff to place guest-ordered items into the cabinet from the hallway and allows the guests to obtain them from inside the room and then place the used dishes and linen items back into the cabinet for pickup. However, to date no such facility is available nor has any been proposed that would be suitable for a hotel or other similar place of public accommodation.

OBJECTS AND SUMMARY OF THE INVENTION

Accordingly, it is an object of the present invention to provide a pass-through cabinet, that would permit pick-up and delivery to the room without need to enter the room or disturb the occupant and which would avoids drawbacks of the prior art.

It is another object to provide a system of pass-through cabinets for hotels or other places of public accommodation that facilitate delivery or pick up of items for the room occupants and which avoid clutter and tripping hazards in the hallways.

It is a further object to provide a mechanism that facilitates ordering meal items from the facility's room food service, and notifying the food service that dishes, trays and similar items are to be returned and are ready for pick-up.

A related object is to provide a mechanism for on-screen ordering of additional linen or toiletry items, and to provide a way for the hotel staff to deliver same without need to enter the guest room.

According to an aspect of the present invention, a wall-mounted pass-through cabinet, suitably configured, may provide a solution to these issues, and also provide additional useful data for analysis. The pass-through cabinet is favorably mounted in the room on the wall that is common to the room and the hallway, and has one or more controlled access doors or closures both on the hallway side and on the room side.

A touch-screen panel on the hallway side may be used by the hotel staff to open the hallway-side door so the items can be placed into the appropriate compartments in the cabinet, or items to be returned can be removed from the compartments. Alternatively, a hand-held wireless device, or a device mounted on the hotel food-service cart or housekeeping cart can be used to access the hallway-side door.

In keeping with the principles of the invention, a pass-through convenience cabinet is configured for use in a public accommodation, such as a hotel, resort, or similar guest facility, where there is at least one hallway and a plurality of rooms along the hallway, each having a common wall shared by the room and the hallway such that the common wall has a hallway side and a room side. Each of the rooms has a pass-through cabinet, wherein the cabinet comprises as follows:

a cabinet body configured to be disposed on the room side of the wall at a penetration to the hallway side of the common wall at which the cabinet body is mounted;

a hall-side door mounted on the cabinet body on the hallway side of the common wall at the penetration, where each such hall-side door can be controllably opened and closed by hotel staff;

one or more compartments on the room side of the cabinet body, each compartment (except a room-safe compartment) being accessible from the hallway side when the hall-side door is opened;

either a single room-side door or a plurality of room-side doors provided respectively for the cabinet compartment(s), and each such room-side door being openable and closeable from inside the respective room—there may be a single compartment with a single room-side door, with access to a plurality of shelves, or in some cases a single shelf;

an electronic control mechanism incorporated into the cabinet on the room side thereof and configured to permit the guest within the room to unlock and open each of the respective room-side doors; and an interlock mechanism for hallway-side door and the room-side door(s), permitting the hallway-side door to be opened only when all of the room-side doors are closed; and permitting the room-side doors to be opened only one door at a time and only when the hallway-side door is closed.

In a favorable configuration, there are first and second compartments arranged vertically one above the other, e.g., one for food items and one for linen or toiletry items. Favorably, the compartment that is adapted for receiving and holding a ready-to-eat food product can include a mechanism for maintaining a tray of warm food products at a heated temperature or a tray of cold food items at chilled temperature.

The electronic control mechanism can include a touch-screen mechanism with a means for indicating that an item has been placed, via the hallway-side door, into one of the compartments. This can include a flashing light, an audible sounder, a mechanism to send an email or text message to the guest, or a visual indicator on the display (TV, tablet, touchscreen monitor, or external light). The electronic control mechanism may permit the guest to enter an access code in some cases, although typically the guest would not require any special code to open the respective room-side door for that compartment or compartments, but can open the door simply by pressing an unlock key or button. Also simply pressing a button on the screen can send a signal to the housekeeping or kitchen staff that a dirty towel or a no-longer-needed food service tray is ready to be picked up. The electronic control mechanism can includes a functionality for communicating with a guest-services computer of the hotel or public accommodation, configured to permit the guest in that room to request food service or linen service directly from the touch-screen mechanism.

A hotel service cart for carrying a food item and/or a linen or toiletry item to one or more rooms of the plurality of rooms can include a portable wireless device operative to permit a staff member to enter a code to open the hallway-side door of the guest rooms. This device may be hand-held and used with the cart, or may be affixed onto the cart.

A key-actuated lock may be used to open the hallway side door in case the hotel computer system fails, or simply to over-ride the electronic system when required.

In some configurations, the outside or hallway-side door may have a control touchscreen panel for accessing the cabinet from the hall side, while in other implementations the control touchscreen panel may be omitted, and a tablet/smart-phone/laptop could be used to open the cabinet door. In addition, the door can be made of steel, wood, or composite to match the hall décor. Favorably, the hallway-side cabinet door is flush with the hallway side of the wall, while the body of the cabinet projects a short distance into the room (or into the closet of the room).

The cabinet doors are set up to only allow the hallway side door or the room-side door(s) to be opened at a time. This affords privacy, as one or the other of the hallway-side and room-side is closed, precluding any view into the room (when one of the two doors is opened, the other remains locked). Favorably, the lock manual override is only available in an emergency or if the electronics fail.

The pass-through cabinet can be connected to the hotel ethernet (wired or wirelessly). The hotel guests' user name or ID's and passwords can be downloaded to the cabinet from a central PC, e.g., during check-in, and an audit trail is maintained—who opened the cabinet, what time, what compartments were opened.

The in-room portion of the cabinet frame preferably rests within the hotel room closet (e.g., see FIG. 5A), so that the cabinet does not protrude into the main living space. The actual cabinet for hotels may need two or three interior compartments, one for breakfast trays and one for linen or toiletry items, and the optional safe compartment. In many cases only a single compartment is needed—with two shelves, a bottom compartment for breakfast trays, a top compartment for dirty towels, etc. In this configuration, the guest is notified by a light on the cabinet that the cabinet has something in it, and pushing a button on the screen would unlock the cabinet to open the door for access to the two shelves in the compartment.

Pressing a button on the touch-screen panel (or tablet) from within the room opens the respective door to return the tray or dirty towels. In doing so a message is automatically sent to hotel personnel that the used tray is to be returned or that items such as a dirty towels are ready to be exchanged (without the room needing to be entered). Alternatively, this notification can be automatic without the need for the guest to push a button. That is, when the cabinet door is entered for a second time (returning the trays), the notification can be sent by text/email to the designated staff member.

In another favorable embodiment, a locked safe compartment can be included in the cabinet body, with a locked door that can be accessed from within the room by entry of a guest-selected code on the touch screen panel. In this case, there would not be access from the hallway-side to the safe compartment.

In addition to keeping the facility hallways uncluttered and not having to open the door to a stranger or hotel employee when the guest may not be fully dressed, the system creates an audit trail that can be used to track delivery times for different employees, and let the hotel easily know when dirty trays can be picked up. This also corrects an issue the staff or guests may have with "odor" from the uncollected food trays.

If a compartment of the cabinet is broken into, and not opened using the standard electronic methods, unauthorized access is identified, and a signal is immediately sent to security by IM, cellular text message, or email, for security staff to investigate.

In summary, the pass-through hotel cabinets of this invention do provide a number of significant advantages, namely,

- Secure entry from within the guest room closet
  - Notification to guest services central station when a tray is returned to cabinet (either automatically, at second door opening, or manually by pushing a button on screen).
  - Notification within the room by visual notification, such as screen color change, change in text on screen. An audible sound may be used in some instances. Automatic dialing of room phone number when food-service tray has been delivered to room may be employed in some cases.
  - Available notification to housekeeping when soiled towels or other linens need replacing and have been placed in the cabinet (automatically or manually).
  - Third door and compartment are available for safekeeping, only accessible from room side.
  - Audit trail to track delivery times of room service items, response times to remove used trays, response times to replace soiled towels, which data may be used for hotel personnel management or other purposes.

The touch screen panels used on the room-side and in some cases on the hallway-side doors, may be 7-inch touch-screens. The screen on the outside or hallway-side can have a touchscreen display that be a decorative picture, or may match wall covering, although this device may be absent if connection is by a tablet/smart-phone/laptop device. The room-side touchscreen may show buttons (soft keys) to request towels or notify housekeeping that towels or a dirty tray is present, or can appear as a numeric pad to enter the safe. The room-side touch screen device may also be used to notify the front desk of other information, such as a desire for the guest to check out of the room. Access to the room-side door or doors may be from a tablet PC in place of the touch-screen, or may be accessed via the room television screen. Interaction with the hotel/housekeeping/room-service central computer system is also an important feature that has not been addressed earlier.

The pass-through cabinet can be opened only from one side at a time, which maintains privacy in the guest room. The cabinet may incorporate door sensors (e.g., magnetic, proximity, or electro-mechanical) to indicate whether a door is open or closed. This can also be used to signal unauthorized entry.

The door interlock feature may be software-based, so that when a room-side door sensor reveals a door is unlatched, the wall-side door motor or solenoid is disabled, through software, from opening the hallway-side door.

The above and many other objects, features, and advantages of this invention will become apparent from the ensuing description of selected preferred embodiments of this invention, with reference to the accompanying Drawing.

DETAILED DESCRIPTION OF THE PREFERRED EMBODIMENTS

Figure 1:
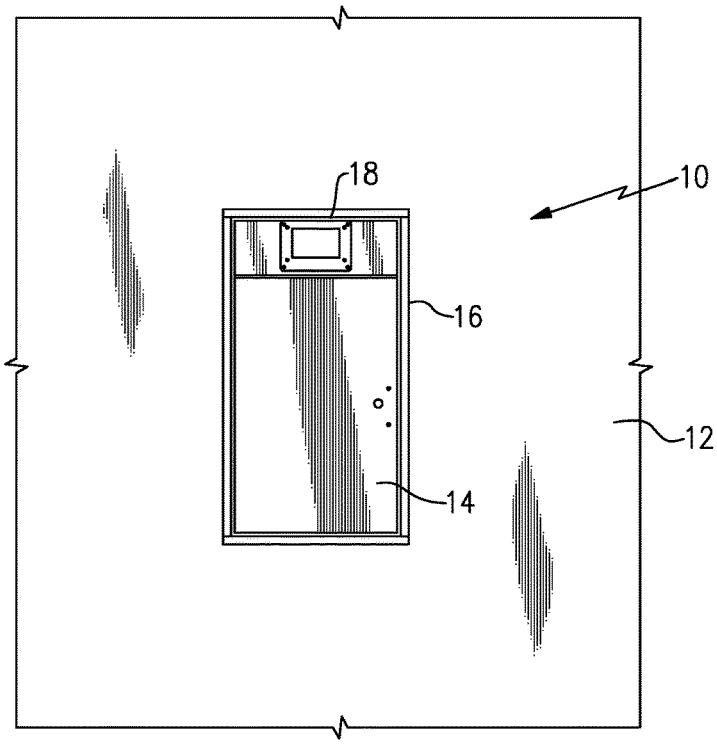
FIG. 1 is a hallway-side view of the hallway-side door of the pass-through cabinet according to one embodiment of this invention.
Figure 2:
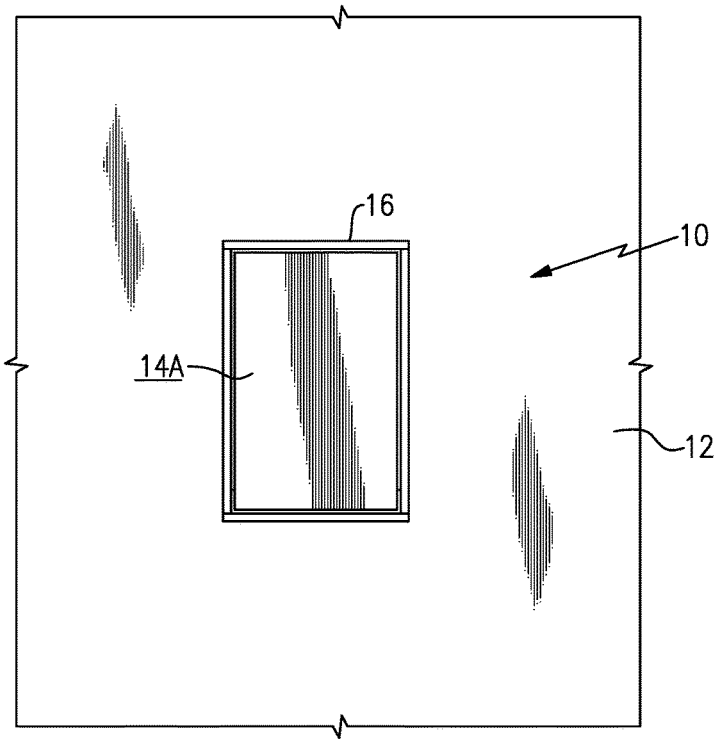
FIG. 2 is a hall-way side view of the hallway-side door of an alternative preferred embodiment.
Figure 3:
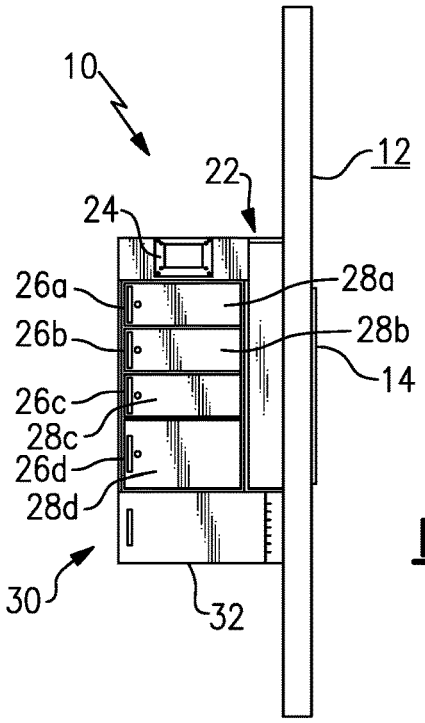
FIG. 3 is an elevation showing the cabinet body mounted on the room-side of the wall that separates the room (to the left here) from the hallway (to the right), this embodiment including a security room safe.
Figure 4:
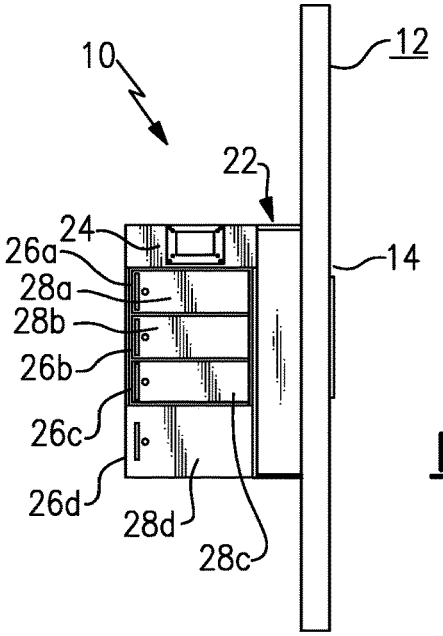
FIG. 4 is a similar elevation showing the cabinet body, here without the room safe.
Figure 5:
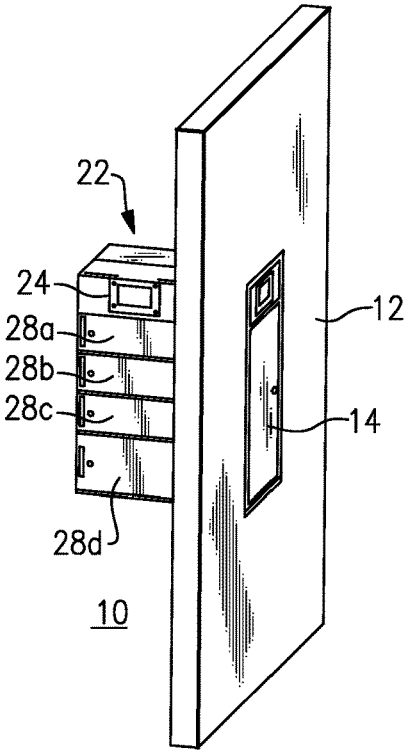
FIG. 5 is a perspective view showing the outside or hallway-side door and showing the cabinet body and room-side doors, on respective sides of the common wall between the guest room and the hallway.

With reference to the Drawing, and initially to FIGS. 1 to 5 thereof, a built-in pass-through hospitality cabinet 10 is shown from the hallway side in FIGS. 1 and 2, from in a cutaway showing both the room-side and hallway-side in FIGS. 3 and 4 and in a perspective showing both the hallway side and room side in FIG. 5. The cabinet for each room is mounted in a wall 12 that is common both to the guest room and to the hallway, with a door 14 opening to the hallway, as shown in FIG. 1. The door 14 fits into a door frame 16 mounted in a penetration of the wall 12, and above the door 14 there may be a touch panel screen 18 that can be used by staff personnel to open the hall-side door 14. A key-operated lock 20 for the door 14 may be used in some embodiments to access the pass-through cabinet 10 from the hall side, or in other cases may be used as an over-ride to open the door 14 during times of power outage, for example. As an alternative, as shown in FIG. 2, a hall-side door 14A may be provided with no touch screen device and with the key operated lock omitted or concealed. Here the door 14A may be covered with wall covering to match wall covering for the hall-side wall.

As shown in FIGS. 3, 4, and 5, the cabinet 10 has frame 22 that is mounted into the opening or penetration in the wall 12. At the top is positioned a touch-screen panel 24 for opening compartment doors on the room side to access compartments in the cabinet.

Figure 5A:
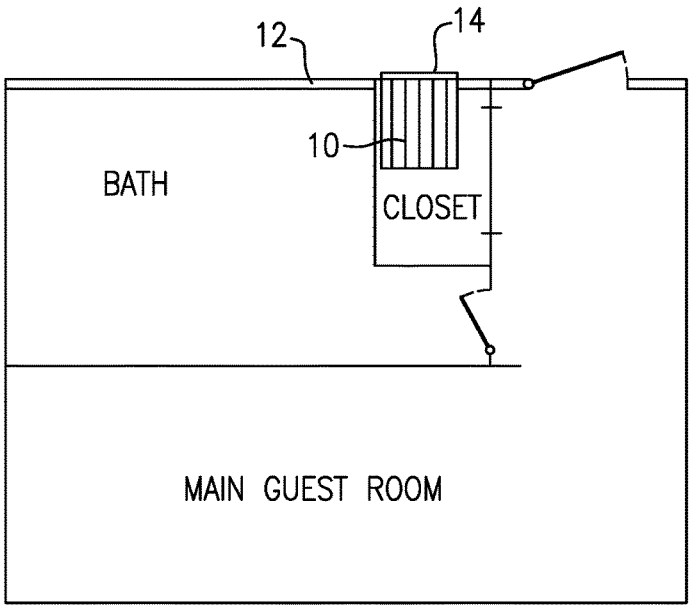
FIG. 5A is a plan view of a hotel room incorporating the pass-through cabinet of this invention.

In a favorable embodiment the cabinet 10 has a number of cabinet compartments 26*a*, 26*b*, 26*c* and 26*d*, stacked one above the other, and there are associated locking doors 28*a*, 28*b*, 28*c*, and 28*d* for these compartments, respectively. In practice, there would typically be a maximum of three doors on the room side. In this embodiment the room-side doors are hinged to open from the side, i.e., opening at a right angle to the plane of the wall 12. Where the cabinet 10 is mounted within the hotel room closet (e.g., see FIG. 5A), this positions the compartment doors and the touch screen so that they are facing the hotel room guest when he or she is looking into the closet. As aforementioned, on the hallway side there is a single cabinet door 14. In some embodiments, there may be as few as two compartments, one for the delivery of meals from hotel room service and later for holding the dishes and tray for pickup, and the other for depositing soiled towels or linens for exchange. However, here there are four compartments, so that two of them may serve for food delivery and dish pickup, and two for towels, blankets, etc., or for other deliveries that may be needed. In the embodiment as shown in FIG. 3 an additional compartment serves as a room safe 30 with a room safe locking door 32. This compartment is not available from the hall side, and is not accessible through the hall-side door 14 or 14A. The door may be operable by punching in a user-selected code or number sequence on the room-side touch screen device 24.

The food service compartment or compartments, e.g., 26*a* and/or 26*b*, may be configured with heating or refrigeration device, e.g., a low power heater or a Peltier-effect solid state cooler, to keep a warm meal warm or to keep a cold food item chilled. Each of the doors 28*a* to 28*d* may incorporate a small flasher or other indicator to announce that the hotel staff have completed a delivery to the respective compartment. Alternatively, the touch-screen device's display may show a message that the delivery has been made and the respective compartment may be accessed to retrieve the meal or linen article. Alternatively, the delivery to the pass through cabinet may automatically trigger a phone call to the room with a recorded announcement.

Figure 6A:
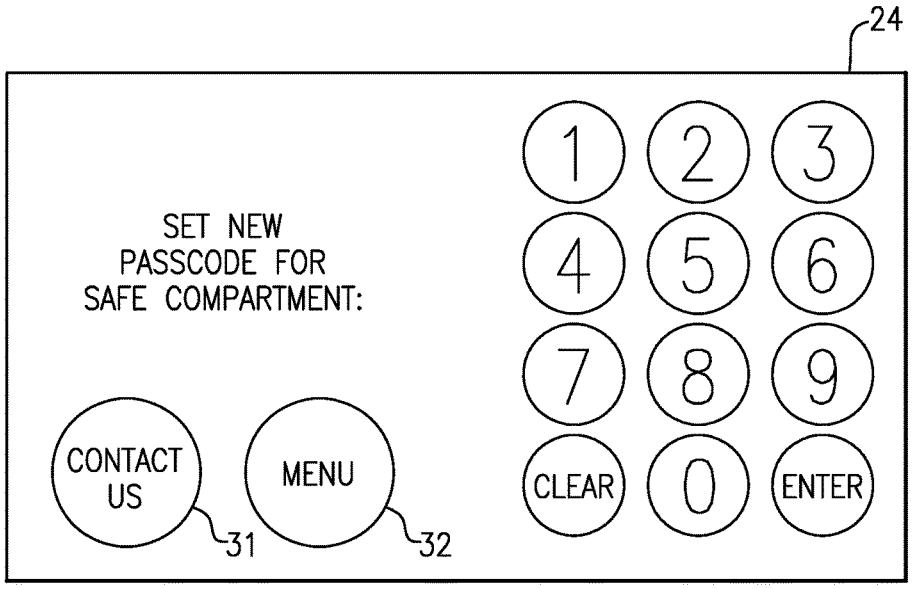
FIG. 6A is an elevation of a touch-screen panel that may be employed in embodiments of this invention.

FIG. 6A illustrates the screen of the touch screen device 24 with one possible screen view, here showing an array of touch buttons on the screen, for example to program and then open the room safe 30. The touch screen may have many other screen views and functionalities, e.g., to display a menu of food items from the hotel's room service to permit the guest to order a meal directly from the touch screen 24, or to request a linen exchange from housekeeping stag or to request other products or services from the hotel or other public accommodation. In this embodiment, there are number keys at the right together with a "clear" button or key and an "enter" key, and first and second soft keys 31 and 32, which may change functions depending one the status of the cabinet. Here, the left key 31 may serve as a contact key to request a contact with the front desk or other staff person, which may result in a text message appearing on the screen or a phone call, and the right soft key 32 may serve as a menu key to call up various screens, e.g., to order a meal from room service or to request a linen or toiletry item, e.g., towel, sheet, soap, shampoo or toothpaste. This screen also allows the guest occupying that room to enter a security code for the room safe compartment (which is not accessible from the hall-side door).

Figure 6D:
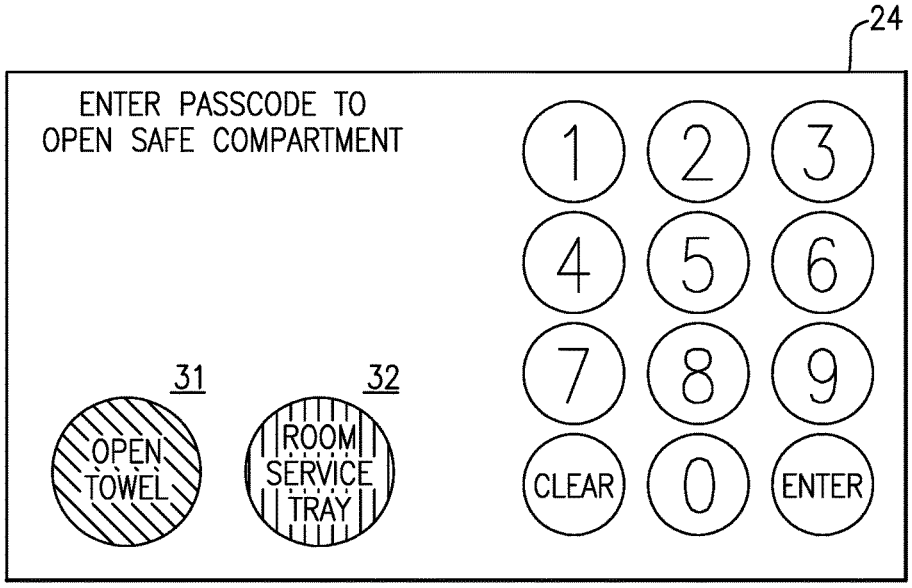
FIGS. 6B, 6C, and 6D show the touch screen panel with displays to indicate status of the pass-through cabinet.
Figure 6B:
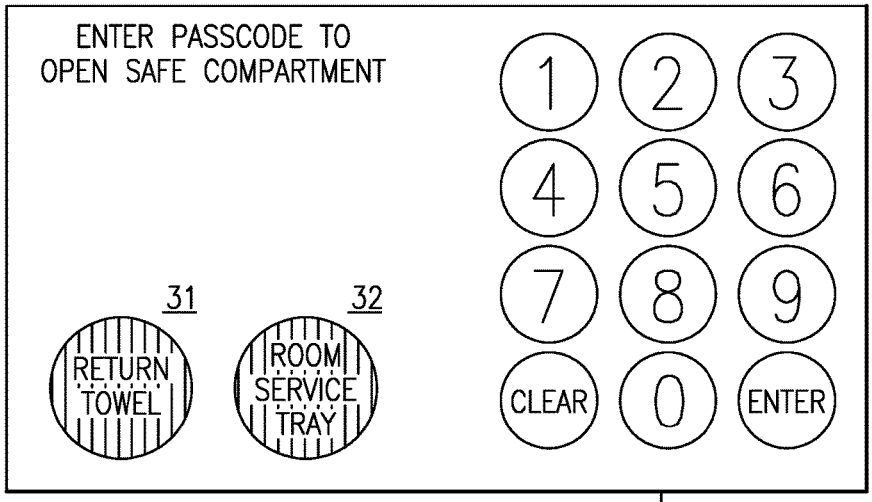
Figure 6C:
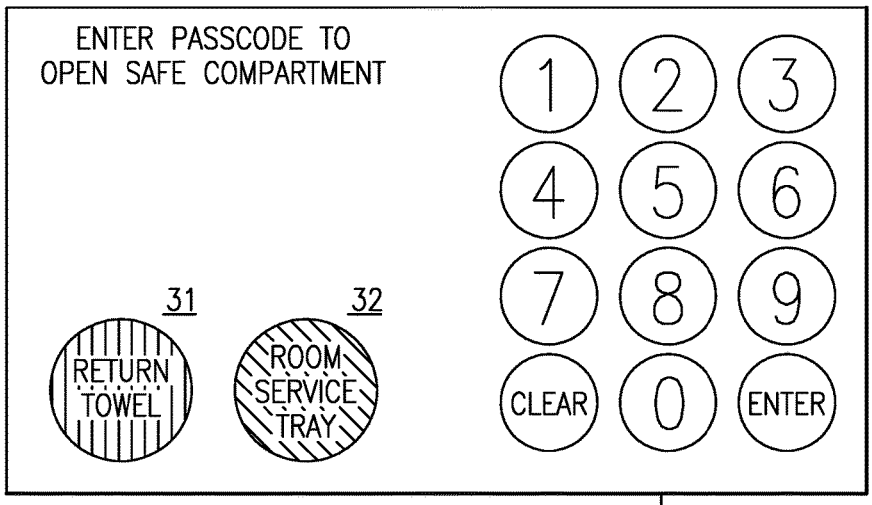

In the screen shown in FIG. 6B, the soft keys 31 and 32 are in a default configuration where there is no food service tray and no linen or toiletry item in the cabinet compartment, and so both of these soft buttons are shown in red (represented by vertical lining). In FIG. 6C, the right soft key 32 is shown in green (represented by diagonal hash lining) to indicate that the key is active, and either a tray of food has been brought up by room service staff, or the guest has replaced the tray into the compartment after the meal. In one case, pressing the soft key 32 can open the room-side door, and in the other case, pressing the soft key 32 transmits a pick-up message to the room-service staff to collect the tray from the cabinet.

In FIG. 6D, the left soft key 31 is colored green, and the room service tray key 32 is red. In this configuration, pressing the soft key 31 opens the room-side door of the cabinet and allows the guest to remove a towel or other linen (or toiletry) item that has been placed there by hotel staff.

In each of these configurations, the guest can access the room-safe compartment of the cabinet by entering the previously-set passcode. Software for the cabinet and displays may tie to cabinet indicator lights, which are automatically activated when items are placed into the compartment(s) of the cabinets. The soft key buttons allow the guest to open specific cabinet doors and also notify housekeeping or food service that certain items are ready for pickup. Also, if there is an unauthorized attempt at entry, i.e., if a door is forcefully opened, an alarm is transmitted to the security staff.

As stated earlier, the housekeeping staff and food service staff may use a hand-held wireless device to access the outside or hall-side door 14 or 14A for a given room when making a delivery or pick-up. Alternatively, as shown in FIG. 6, a room-service cart or housekeeping cart 40 may have an on-cart touch screen portable wireless device 42 attached to it or incorporated into it, and may open the room's hall-side door automatically when the cart approaches the room.

Figure 6E:
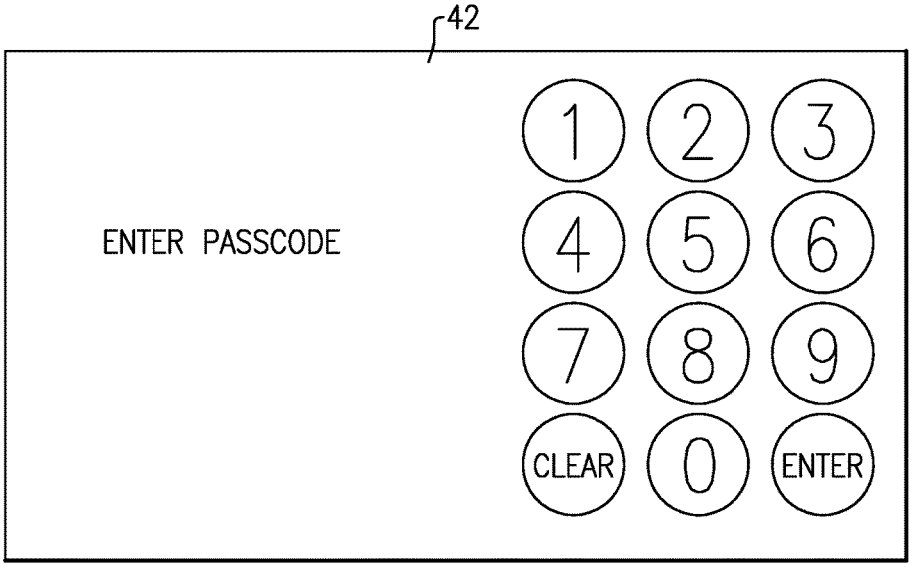
FIGS. 6E and 6F are views of the screen of a portable device used by staff to access the hall-side doors of the cabinets of this invention.
Figure 6F:
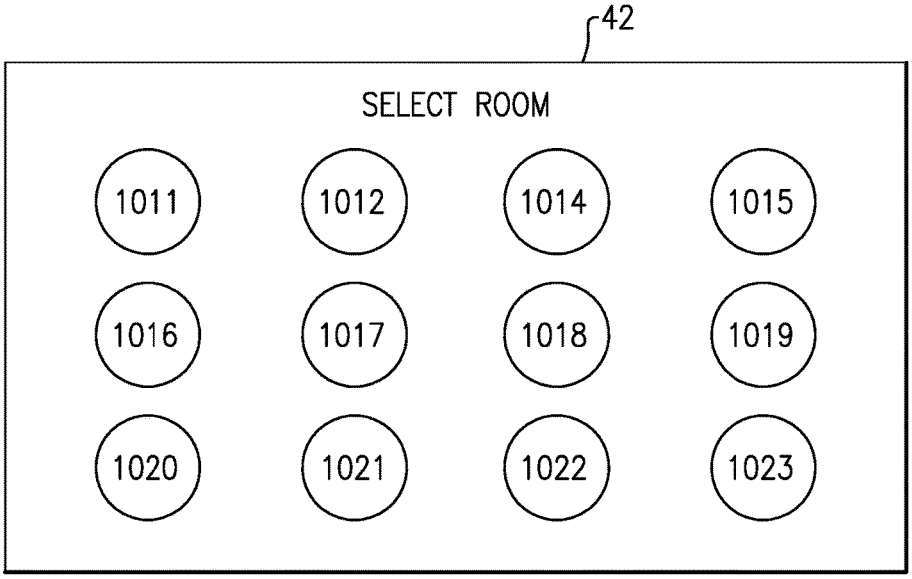
Figure 7:
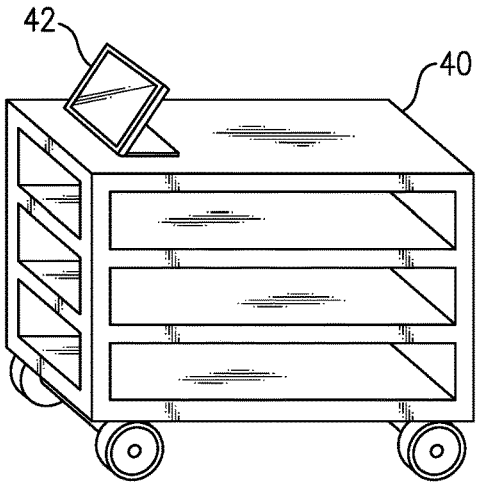
FIG. 7 is a perspective of a hotel service cart that includes a portable touch screen device that may be used to access the pass-through cabinets of this invention.

FIG. 6E shows the screen of the hotel staff device 42, here presenting the number keyset to allow the staff member to enter his or her personal work passcode. Favorably, the staff member only needs to sign in once for a round of deliveries and pick-ups. This results in the screen shown in FIG. 6F, where the staff member can select the room number for a delivery or pick-up to open the appropriate hallway-side door 14. Favorably, those room numbers for guests that have placed an order for delivery or pickup would be highlighted, i.e., flashing or a distinctive color. Opening the cabinet outside door 14 activates a light or other indicator that a service tray has been delivered. The software can easily track data such as time of each delivery and pick-up and the identity of the staff employee, to create an audit trail to quantify delivery metrics. These data can be used for management purposes. Of course, as mentioned earlier, the door interlock prevents interior and exterior doors from being open at the same time.

Rather than employing the touch screen for sign-in, the staff member may log in using a bar code or magnetic stripe, an RFID or other proximity card, finger print or retinal scan, or a login on an external tablet device.

The compartments may also have a lock over-ride, opened using a key and cylinder.

In favorable embodiments of this invention, the hallway-side door 14 is substantially flush with the corridor side of the wall 12, and the cabinet 10 does not project into the hallway or corridor, where space is often limited. In other implementations, the door can be recessed somewhat, so that the door 14 itself does not project into the hallway.

In the preferred embodiments, there is an internal interlock feature whereby only one of the room-side doors 28*a*, 28*b*, 28*c*, and 28*d* can be opened at any one time, and the outer or hallway-side door 14 can only be opened when all of the room side doors 28*a* to 28*d* are closed. The accessed compartment door has to be closed before another compartment door can be opened. In addition, the interlock allows the outer or hallway-side door 14 to be opened only when all of the room-side doors 28*a* to 28*d* are shut, and also allows the room-side doors 28*a* to 28*d* to be opened only when the hallway-side door 14 is shut. This feature precludes having inside doors and outside door or doors opened at the same time. This feature protects the guests' privacy, as it makes it impossible to see into the room through the cabinet.

In other possible embodiments, where room configuration permits, the compartments 26*a* to 26*d* may be arranged side-by-side rather than vertically. In that case, the compartment doors may be in the form of lids that swing open upwards.

Another potential configuration can have a single door on the hallway side, as before, and a single room-side door on the cabinet, with the cabinet having two shelves. The shelves can be designated for linen exchange, e.g., to replace a towel, and for room service meals, respectively. On the room side, pressing the towel return or linen exchange button or key will open he single room side door, but notify housekeeping services, whereas pushing the room service button or key will notify the room service or kitchen. This single-door option may provide a lower-cost alternative for purchase and installation, and would simplify operation for many hotel guests. This option may also incorporate a room-safe compartment, as discussed earlier, with access only from within the guest room.

Figure 8:
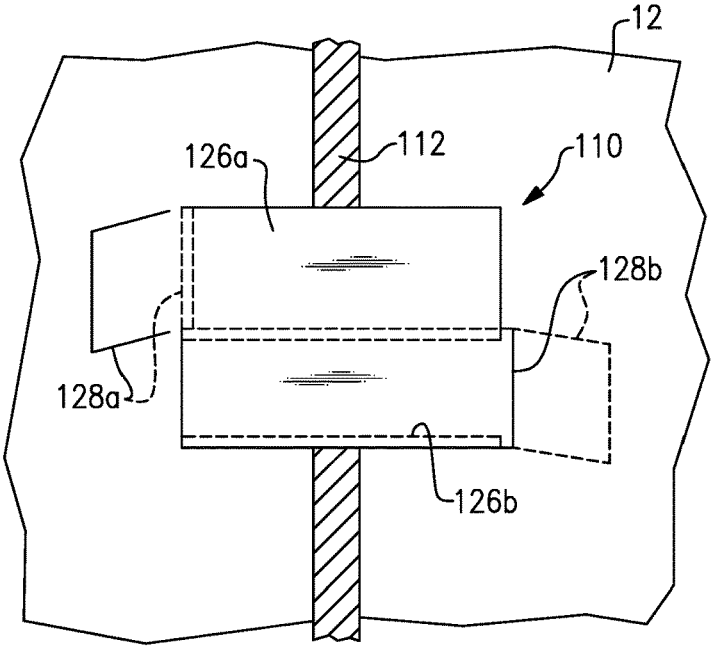
FIG. 8 is a schematic room-side view of an embodiment of the cabinet shared by two adjacent rooms.
Figure 8A:
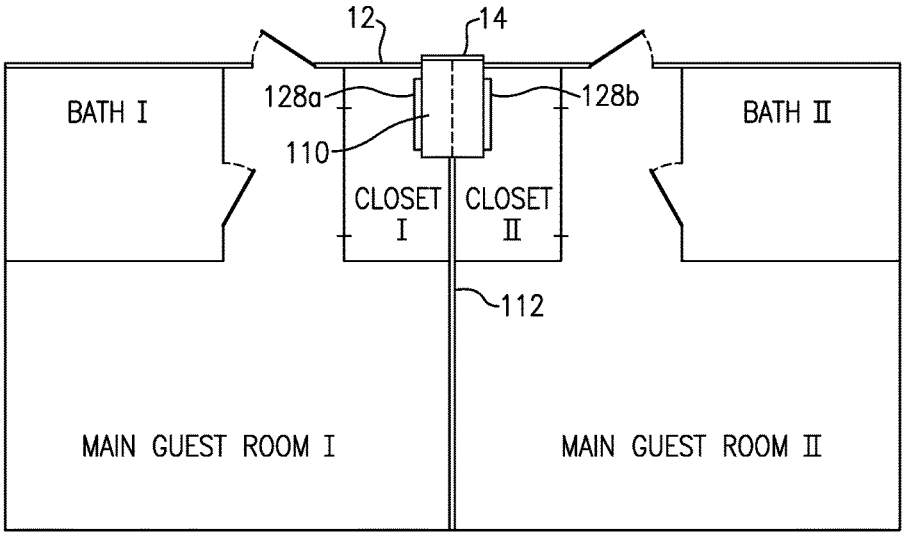
FIG. 8A is a plan view of adjacent hotel rooms incorporating the shared pass-through cabinet of this embodiment.

In a further possible embodiment, with reference to FIG. 8, the cabinet 110 would be shared by two adjacent rooms, e.g., room numbers 1012 and 1014, for example, that share both the common hallway wall 12 and a common dividing wall 112 that separates the two rooms, e.g., within the guest room closet for each room (see FIG. 8A). In this embodiment, the cabinet 110 would have one or more compartments accessible from one of the rooms only, and one or more compartments accessible only from the other room, with both or all compartments being accessible via a hallway-side door, not shown. In this example, there is a compartment 126*a* for one room, which can be at the top, and a compartment 126*b* for the other room beneath, one opening to the left and the other opening to the right. Each compartment has a respective door 128*a* or 128*b*, as shown, which swing open when accessed and unlocked. While the two guest rooms share the same cabinet 110, a tray delivered to the first room would be placed in the cabinet in the upper compartment 126*a*, and could only be accessed from that room via the door 128*a*. A tray designated for the other room would be placed in the lower compartment 126*b*, and would be accessed only through the door 128*b* by the guest in that room. Each side would have a touch screen or other device for signaling that food or towel, for example has been ordered or needs to be picked up. Also, as earlier door interlocks would ensure that only one door could be opened at a time.

Figure 9:
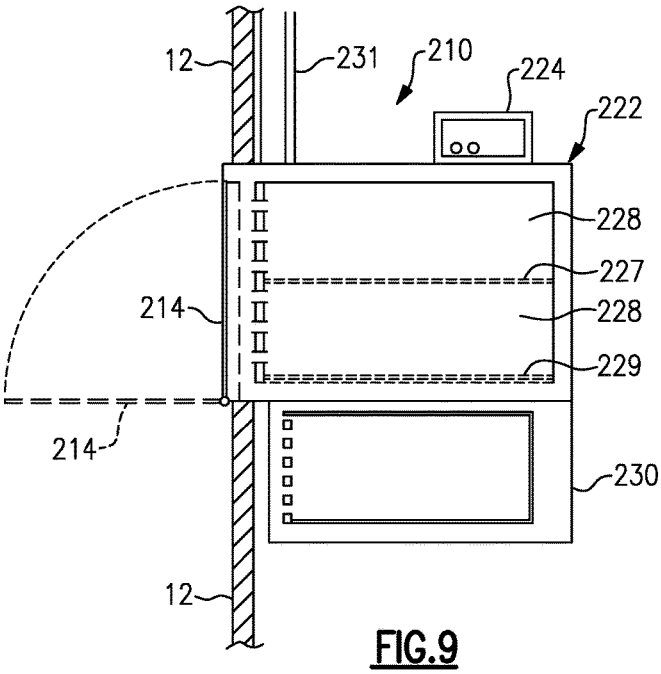
FIG. 9 is a schematic view of a simplified single-compartment embodiment.

FIG. 9 illustrates another practical embodiment in which the pass-through cabinet 210 has a single hallway-side door 214 which opens from the hallway-side of the wall 12 to a single compartment 226 in which there is an upper shelf 227 and a lower shelf 229. Hotel staff may place a linen or toiletry item on the upper shelf 227 and/or may place a food tray on the lower shelf 229. The hotel guest can access both shelves by opening the single room-side door 228 using push button(s) or soft keys presented on the touch screen 224. To return the tray and/or soiled towel the guest places the item into the compartment and shuts the door which signals the housekeeping staff and/or the kitchen that the item is waiting to be picked up. As shown here, this unit may include the optional room safe feature 230.

The unit may be powered with direct current power supplied e.g. via ethernet, that is through an ethernet cable 231, which permits communication but eliminates the need for additional wiring (Power-over-Ethernet, or PoE).

In any of these embodiments, any unauthorized entry or attempt to access or open the room safe or other access door would send an alarm message to the building security.

The audit trail mentioned earlier may contain a number of relevant data fields, including room number, staff member identity code, staff member name, delivery time, promised delivery time, time ready in kitchen, time tray left kitchen for food service deliveries, and may containing room number, time guest placed tray in cabinet, staff ID number, staff name, actual pick-up time.

While the invention has been described in terms of selected preferred embodiments, it should be understood that the invention is not limited only to those embodiments, but rather the scope of this invention is to be measured by the appended claims.

I claim:

1. Pass-through convenience cabinet for a public accommodation wherein the public accommodation includes at least one hallway and a plurality of rooms along said hallway each having a common wall shared by the room and the hallway such that the common wall has a hallway side and a room side;

said cabinet comprising:

a cabinet body configured to be disposed on the room side of said wall at a penetration to said hallway side of said common wall, onto which the cabinet body is mounted;

a hall-side door mounted on the cabinet body on the hallway side of said common wall at said penetration and being controllably opened and closed;

a plurality of compartments on the room side of the cabinet body, each being accessible from the hallway side when said hall-side door is opened;

a plurality of room-side doors provided respectively for said compartments, and each said room-side door being openable and closeable from inside the respective room;

a control mechanism incorporated into said cabinet on said room side thereof and configured to permit a person within the room to open each said respective room-side door; and an interlock mechanism for said hallway-side door and said room-side doors, permitting said hallway-side door to be opened only when all of said room-side doors are closed; and permitting said room-side doors to be opened only one door at a time and only when said hall-way side door is closed.

2. The pass-through convenience cabinet according to claim 1 wherein said plurality of compartments includes at least a first and second compartment arranged vertically one above the other.

3. The pass-through convenience cabinet according to claim 1 wherein at least one compartment of said plurality of compartments is adapted for receiving and holding a ready-to-eat food product.

4. The pass-through convenience cabinet according to claim 1 wherein at least one of said compartments is adapted for holding a linen or toiletry product.

5. The pass-through convenience cabinet according to claim 1 wherein said control mechanism includes a touch-screen mechanism including means for indicating that an item has been placed, via said hallway-side door, into one of said compartments, and means permitting a guest in said room to open the respective room-side door for said one of said compartments.

6. The pass-through convenience cabinet according to claim 5 wherein said control mechanism includes a functionality that communicates with a guest-services computer of said public accommodation, and is adapted to permit the guest in said room to request food service or linen service from said touch-screen mechanism.

7. The pass-through convenience cabinet according to claim 1 wherein said public accommodation includes at least one service cart for carrying a food item and/or a linen or toiletry item to one or more rooms of the plurality of rooms, said cart including a portable wireless device operative to permit a staff member to enter a code to open the hallway-side door of a respective one of said one or more rooms.

8. The pass-through convenience cabinet according to claim 1 wherein said room-side doors are arranged at a right angle to the plane of said common wall.

9. The pass-through convenience cabinet according to claim 1 wherein said control mechanism is an electronic control mechanism connected via an ethernet cable to a guest-services computer of said public accommodation; and the cabinet is electrically powered via said ethernet cable.

10. The pass-through convenience cabinet according to claim 1 wherein said hall-side door is substantially flush with said common wall.

11. Pass-through convenience cabinet for a public accommodation wherein the public accommodation includes at least one hallway and a plurality of rooms along said hallway each having a common wall shared by the room and the hallway such that the common wall has a hallway side and a room side;

said cabinet comprising:

a cabinet body configured to be disposed on the room side of said wall at a penetration to said hallway side of said common wall, onto which the cabinet body is mounted;

a hallway-side door mounted on the cabinet body on the hallway side of said common wall at said penetration and being controllably opened and closed;

at least one compartment on the room side of the cabinet body, the at least one compartment being accessible from the hallway side when said hallway-side door is opened;

a room-side door provided for said at least one compartment, and said room-side door being openable and closeable from inside the respective room;

a control mechanism incorporated into said cabinet on said room side thereof and configured to permit a person within the room to unlock and open the respective room-side door; and an interlock mechanism for said hallway-side door and said room-side door, permitting said hallway-side door to be opened only when the room-side door for at least one compartment door is closed; and permitting said room-side door to be opened only when said hallway-side door is closed.

12. The pass-through convenience cabinet according to claim 11 wherein said at least one compartment includes a first shelf for receiving and returning food service items, and a second shelf for an item of linen or toiletries.

13. The pass-through convenience cabinet according to claim 12 wherein said control mechanism is an electronic control mechanism operative to send a pickup notice signal to a guest-services computer of said public accommodation when a person in the room loads an item to be returned onto one of said shelves in said compartment, and closes the room-side door.

14. The pass-through convenience cabinet according to claim 13 wherein said guest-services computer is operative to store an audit record of orders made by guests, all deliveries made to each said pass-through convenience cabinet, and each pickup made from each said cabinet.

15. The pass-through convenience cabinet according to claim 12 wherein said control mechanism is adapted to communicate wirelessly with a hand-held device for opening said hall-side door.

16. The pass-through convenience cabinet according to claim 11 wherein said control mechanism is an electronic control mechanism connected via an ethernet cable with a guest-services computer of said public accommodation; and wherein the cabinet is powered through said ethernet cable.

17. Pass-through convenience cabinet for a public accommodation wherein the public accommodation includes at least one hallway and a plurality of rooms along said hallway each having a common wall shared by the room and the hallway such that the common wall has a hallway side and a room side, and to be shared by two adjacent rooms separated by a dividing wall;

said cabinet comprising:

a cabinet body configured to be disposed on the room side of said wall at a penetration to said hallway side of said common wall, onto which the cabinet body is mounted, and wherein said cabinet is situated in said dividing wall so as to extend into both rooms of said two adjacent rooms;

a hallway-side door mounted on the cabinet body on the hallway side of said common wall at said penetration and being controllably opened and closed;

at least two compartments on the room said of the cabinet body, each being accessible from the hallway side when said hall-side door is opened, and wherein at least one of said compartments is accessible only from one of said two adjacent rooms, and another of said compartments is accessible only from the other of said two adjacent rooms;

at least two room-side doors provided respectively for said compartments, and each said room-side door being openable and closeable from inside the respective one of said two adjacent rooms;

a control mechanism incorporated into said cabinet on said room side thereof and configured to permit a person within the respective room to open the respective room-side door; and an interlock mechanism for said hallway-side door and said room-side doors, permitting said hallway-side door to be opened only when all of said at least two room-side doors are closed; and permitting said room-side doors to be opened only one door at a time and only when said hallway-side door is closed.

18. The pass-through convenience cabinet according to claim 17 wherein said control mechanism is an electronic control mechanism operative to send a pickup notice signal to a guest-services computer of said public accommodation when a guest in one of said two adjacent rooms loads an item to be returned into said cabinet, and closes the respective room-side door.

19. The pass-through convenience cabinet according to claim 18 wherein said guest-services computer is operative to store an audit record of orders made by guests, all deliveries made to each said pass-through convenience cabinet, and each pickup made from each said cabinet.

20. The pass-through convenience cabinet according to claim 17 wherein said control mechanism is an electronic control mechanism connected via an ethernet cable with a guest-services computer of said public accommodation; and wherein the cabinet is powered through said ethernet cable.

* * * * *